US005687592A

United States Patent [19]

Penniman et al.

[11] Patent Number: 5,687,592

[45] Date of Patent: Nov. 18, 1997

[54] MECHANICAL LOCK FOR A REMOVABLE HARD DISK DRIVE AND A REMOVABLE MEMORY CARD

[75] Inventors: Mark B. Penniman; John Busch, both of Austin, Tex.

[73] Assignee: Dell USA, L.P., Austin, Tex.

[21] Appl. No.: 96,318

[22] Filed: Jul. 23, 1993

[51] Int. Cl.[6] ..... E05B 73/00

[52] U.S. Cl. ..... 70/14; 70/58; 70/168; 361/683

[58] Field of Search ..... 70/14, 57, 58, 70/163, 164, 158, 166–169; 248/553; 361/683, 679; 364/708.1

[56] References Cited

U.S. PATENT DOCUMENTS

| | | | |
|---|---|---|---|
| 2,584,708 | 2/1952 | Jenkins | 70/164 X |
| 4,252,007 | 2/1981 | Kerley | 70/58 |
| 4,570,465 | 2/1986 | Bennett | 70/58 X |
| 4,600,249 | 7/1986 | Anderson | 361/683 |
| 4,685,312 | 8/1987 | Lakoski et al. | 70/58 X |
| 4,794,587 | 12/1988 | Cordiano | 70/58 X |
| 4,898,009 | 2/1990 | Lakoski et al. | 70/58 |
| 4,975,550 | 12/1990 | Panchisin | 200/43.01 X |
| 4,985,695 | 1/1991 | Wilkinson et al. | 70/58 X |
| 5,027,627 | 7/1991 | Derman | 70/164 |
| 5,119,649 | 6/1992 | Spence | 70/58 X |
| 5,154,456 | 10/1992 | Moore et al. | 70/58 X |
| 5,228,319 | 7/1993 | Holley et al. | 70/58 |
| 5,327,752 | 7/1994 | Myers et al. | 70/14 X |
| 5,331,506 | 7/1994 | Nakajima | 361/683 |

FOREIGN PATENT DOCUMENTS

| | | | |
|---|---|---|---|
| 2202381 | 9/1988 | United Kingdom | 361/683 |

*Primary Examiner*—Lloyd A. Gall

*Attorney, Agent, or Firm*—David McCombs; James W. Huffman

[57] ABSTRACT

A combined removable hard disk drive and removable memory card mechanical lock which provides a portable computer user with an easy and cost effective arrangement to lock inside the computer expensive modular components such as a hard disk drive and memory cards. When installed on a portable computer, the combined lock will prevent the removable hard disk drive and removable memory cards from being removed from the portable computer.

11 Claims, 6 Drawing Sheets

MECHANICAL LOCK FOR A REMOVABLE HARD DISK DRIVE AND A REMOVABLE MEMORY CARD

TECHNICAL FIELD

The invention relates generally to the field of portable computers and more specifically to a mechanical lock for preventing the removal from a laptop or notebook computer of modular components such as a removable hard disk drive and a memory card.

BACKGROUND OF THE INVENTION

Portable computers, such as laptop and notebook computers, now include ports that can accommodate modular components such as hard disk drives, memory cards and modems that can be removed, swapped out or upgraded. The housings for such portable computers have been downsized to the point that the internal spatial requirements of such computers have required the establishment of standards for the internal accessories of the computer. One set of standards applicable to memory cards has been developed by the Personal Computer Memory Card International Association (PCMCIA). The PCMCIA has determined that the standard size of all memory cards used in portable computers should be approximately 55 mm in width, 85 mm in length and 5 mm in depth. Communications card manufacturers have adopted the PCMCIA standards for their communications cards to ensure compatibility and spatial conformity with computers utilizing the PCMCIA standards.

The constraints imposed by the PCMCIA standards have resulted in the development of "credit card" communications cards. For instance, most of the components formerly housed within a modem are now contained within a credit card-sized wafer.

The modularity of the hard disk drive, memory cards and communications cards has led to the need for security devices that will prevent theft or vandalism of such components.

As a solution to this problem, removable hard disk drive locks are currently being offered on some portable computer products. For instance, the IBM Thinkpad™ notebook computer has a sheet metal hook and ring feature that slides out from the base of the computer. To lock the hard disk drive, the sheet metal hook and ring feature is pulled out and a small padlock is attached to the ring. The hooks engage and lock the hard disk drive when the sheet metal hook and ring feature is pulled out and the lock prevents the hooks from being disengaged from the hard disk drive. However, such a locking device has certain disadvantages. For instance, when the lock is installed it does not allow the notebook to sit flat. Also, the installation of this lock on a notebook computer requires several additional parts and adds complexity to the plastics tooling of the base of the notebook chassis.

It has also been proposed to provide a solenoid lock for memory card eject mechanisms. A solenoid lock, however, would be costly, would consume valuable battery power and would be prone to reliability problems.

SUMMARY OF THE INVENTION

The foregoing problems are solved and a technical advance is achieved by a mechanical lock for engagement with the chassis of a computer that prevents the removal of one or both of a removable hard disk drive and a removable memory card.

In one illustrative embodiment, the mechanical lock comprises a locking member that is adapted to prevent the opening of a door to a hard disk drive compartment in the chassis of a portable computer. According to this embodiment, the door to the hard disk drive compartment is maintained in a closed position by a sliding bar which engages the chassis of the portable computer. To provide access to the compartment, the sliding bar must be disengaged from the chassis. The locking member of the mechanical lock engages the sliding bar and prevents the disengagement of the bar from the chassis. Accordingly, when the mechanical lock is installed on a portable computer and the locking member is engaged with the sliding bar, a removable hard disk drive disposed in the hard disk drive compartment is locked within the portable computer.

In this embodiment, the mechanical lock also includes a flange that prevents the ejection of a memory card from a memory card slot disposed in the chassis of a portable computer. The flange may cover and prevent actuation of the memory card eject buttons or may partially block the memory card slots. Accordingly, when the mechanical lock is installed on a portable computer, a removable memory card disposed in a memory card slot is locked within the portable computer.

In another embodiment of the present invention, the flange of the mechanical lock is disposed in the path of and prevents the opening of the door to the hard disk drive compartment. Accordingly, when the mechanical lock of this embodiment is installed on a portable computer, a removable hard disk drive disposed in the hard disk drive compartment is locked within the portable computer.

According to a further embodiment of the present invention, the locking member of the mechanical lock engages the door to the hard disk drive compartment and prevents the opening of the door. Accordingly, when the mechanical lock of this embodiment is installed on a portable computer, a removable hard disk drive disposed in the hard disk drive compartment is locked within the portable computer.

A technical advantage achieved with the invention is that the user of a portable computer has an easy and cost effective arrangement by which to lock expensive modular components such as a hard disk drive or memory cards inside the portable computer. When installed, the mechanical lock advantageously prevents one or both of a removable hard disk drive and removable memory cards from being removed from the portable computer.

DESCRIPTION OF THE PREFERRED EMBODIMENT

Figure 1:
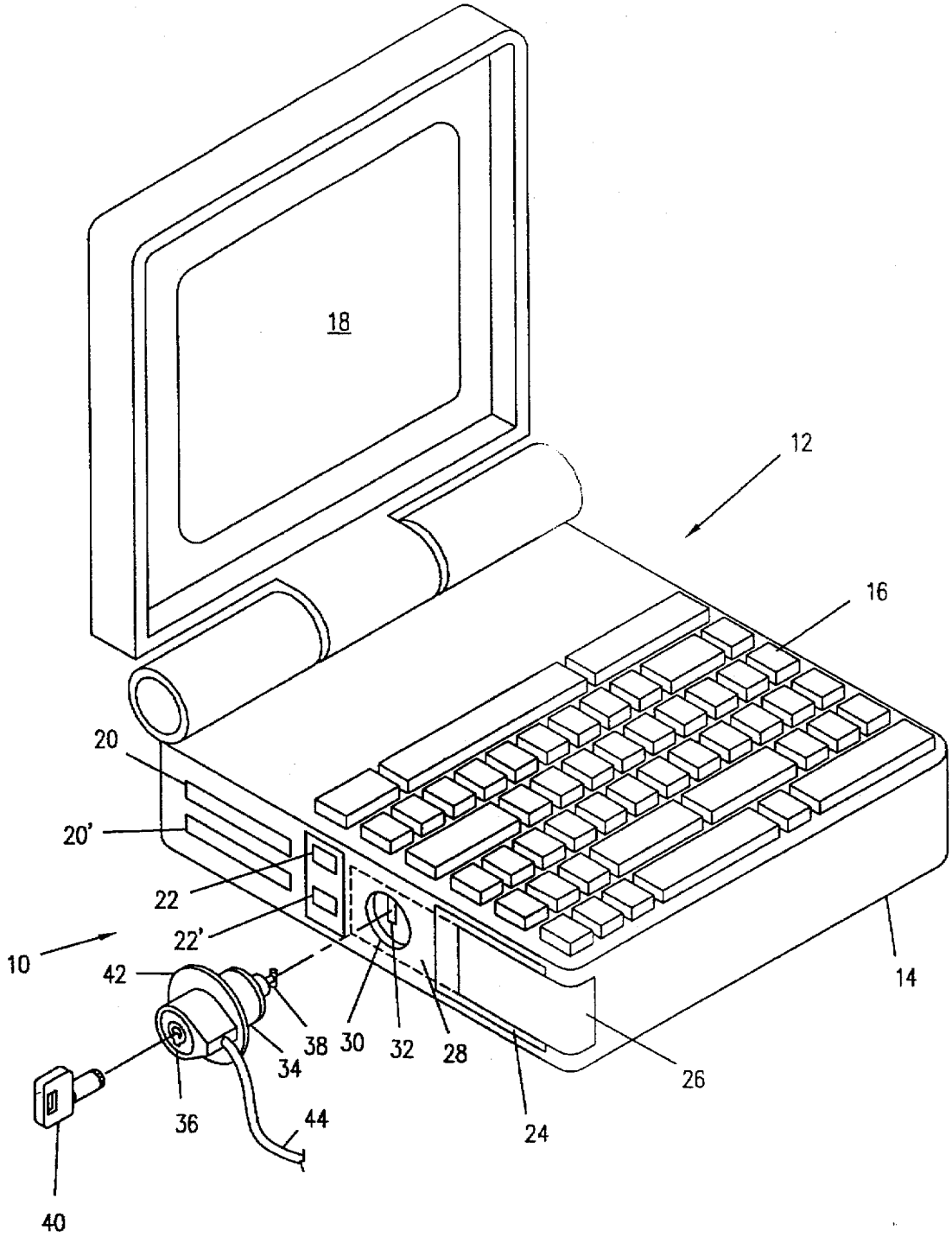
FIG. 1 is a perspective view of the mechanical lock and a portable computer according to the present invention.

In FIG. 1, the reference numeral 10 designates a mechanical lock embodying features of the present invention and the reference numeral 12 designates a portable computer embodying features of the present invention. The portable computer 12 includes a chassis 14, a keyboard 16 and a screen 18. The portable computer 12 also includes memory card slots 20, 20' with corresponding memory card eject buttons 22, 22'. As is customary in the art, the memory card slots 20, 20' are adapted to receive various modular components for a portable computer such as memory cards and communications cards that are configured to comply with PCMCIA size standards. Memory cards can be interacted with the portable computer 12 by inserting the cards in either slot 20 or 20'. When it is desired to remove the memory card from the portable computer 12, the memory card eject button 22 is depressed, releasing the card from within the portable computer 12.

The portable computer 12 also includes a hinged door 24 providing access to a hard disk drive compartment disposed in the chassis 14. The door 24 is maintained in a closed position by a sliding bar 26 which includes a depressed tongue 28. When the tongue 28 is in an extended position as shown in FIG. 1, it engages the inside surface of the chassis 14 of the portable computer 12, thus preventing the opening of the door 24. When it is desired to provide access to the hard disk drive compartment, the sliding bar 26 is moved to the right, releasing the tongue 28 from the chassis 14 and allowing the door 24 to be opened, preferably by pivoting the door 24 about its hinges (not shown) which are disposed at the lower portion of the portable computer 12.

As shown in FIG. 1, a cylindrical opening 30 is provided in the chassis 14 of the portable computer 12. The cylindrical opening 30 registers with an aperture 32 in the tongue 28 so that when the tongue 28 is in its fully extended position, the aperture 32 is visible through the cylindrical opening 30.

The mechanical lock 10 includes a cylindrical lock body 34 and a locking member 36. An end 38 of the locking member 36 is adapted to pass through the aperture 32 in the tongue 28. The other end of the locking member 36 is adapted to receive a key 40 for rotating the locking member 36 from a vertical unlocked position as shown in FIG. 1 to a horizontal locked position as shown in FIG. 2.

The mechanical lock 10 also includes a cylindrical flange 42 disposed about the cylindrical lock body 34. The outer diameter of the flange 42 is greater than the outer diameter of the lock body 34. Optionally, a cable 44 may be attached to the mechanical lock 10. It is understood that the cable 44 may be utilized to lock the portable computer 12 to a secure object. Those of ordinary skill in the art will recognize that a Kensington Microsaver lock may be utilized as the mechanical lock 10.

The mechanical lock 10 is installed on a portable computer 12 by inserting lock body 34 into the cylindrical opening 30 in chassis 14 and consequently inserting the end 38 of locking member 36 into the aperture 32 in tongue 28. The key 40 is inserted into the locking member 36 and is rotated about its axis to rotate the end 38 of the locking member 36 from a vertical unlocked position to a horizontal locked position. As shown in FIG. 2, when the end 38 of locking member 36 is rotated into a horizontal locked position, the end 38 of locking member 36 is captured behind the tongue 28. In this manner, the tongue 28 cannot be disengaged from the chassis 14 and the door 24 consequently cannot be opened to provide access to the hard disk drive compartment. Thus, a removable hard disk drive disposed within the hard disk drive compartment is locked within the portable computer 12.

Figure 2:
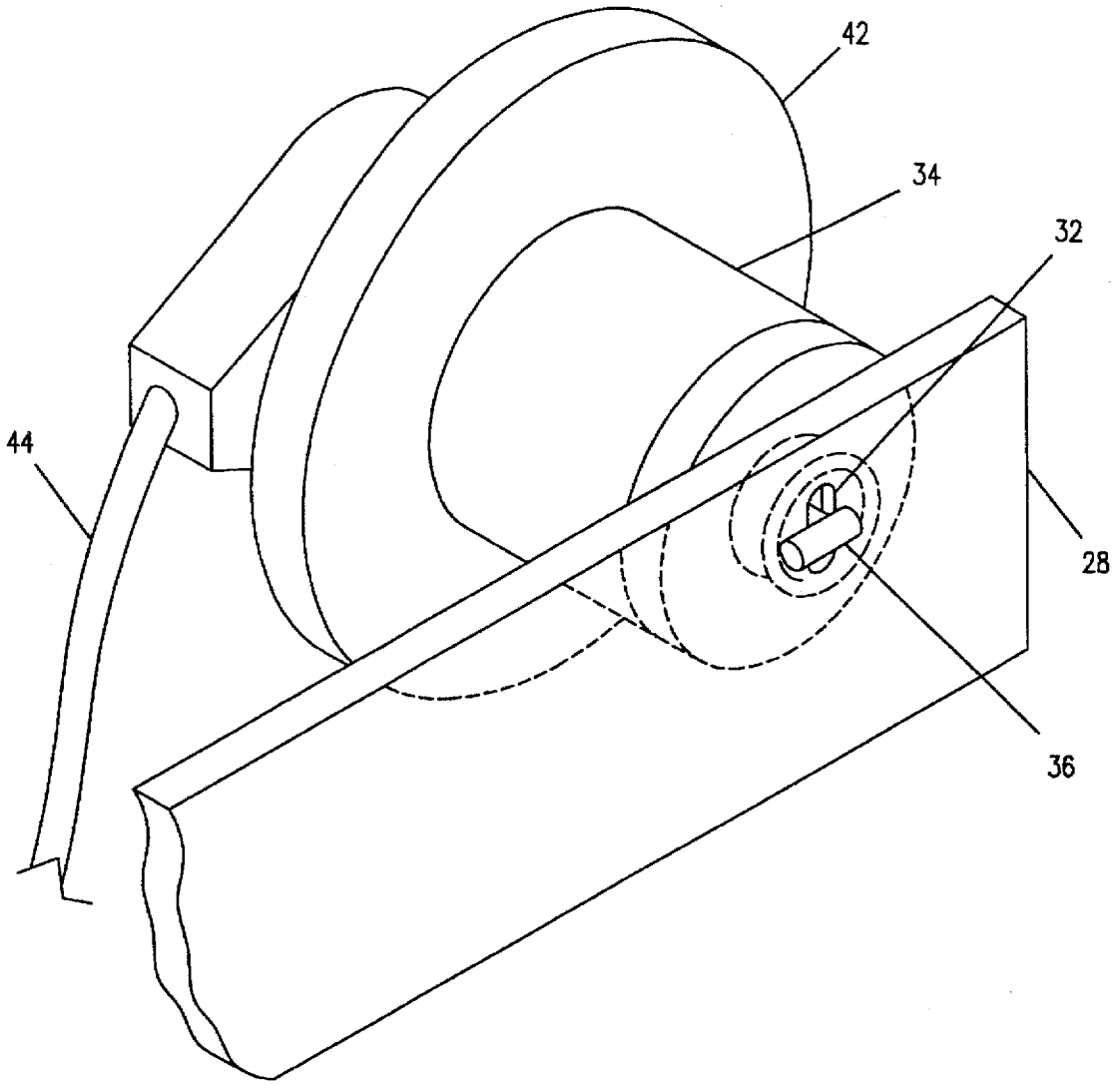
FIG. 2 is a detail view of the engagement of the mechanical lock and the portable computer according to the present invention.

In a preferred embodiment of the invention as shown in FIGS. 1 and 2, the end 38 of locking member 36 is configured as a "T" shaped member and the aperture 32 is a vertically oriented slot. The end 38 of locking member 36 is designed to pass through the aperture 32 in the tongue 28 of sliding bar 26 and may be rotated 90° to lockingly engage the mechanical lock 10 and the portable computer 12. It will be understood that the end 38 of locking member 36 and the aperture 32 of tongue 28 may be configured in various other lockingly cooperative configurations that are well known to those of ordinary skill in the art.

Figure 3:
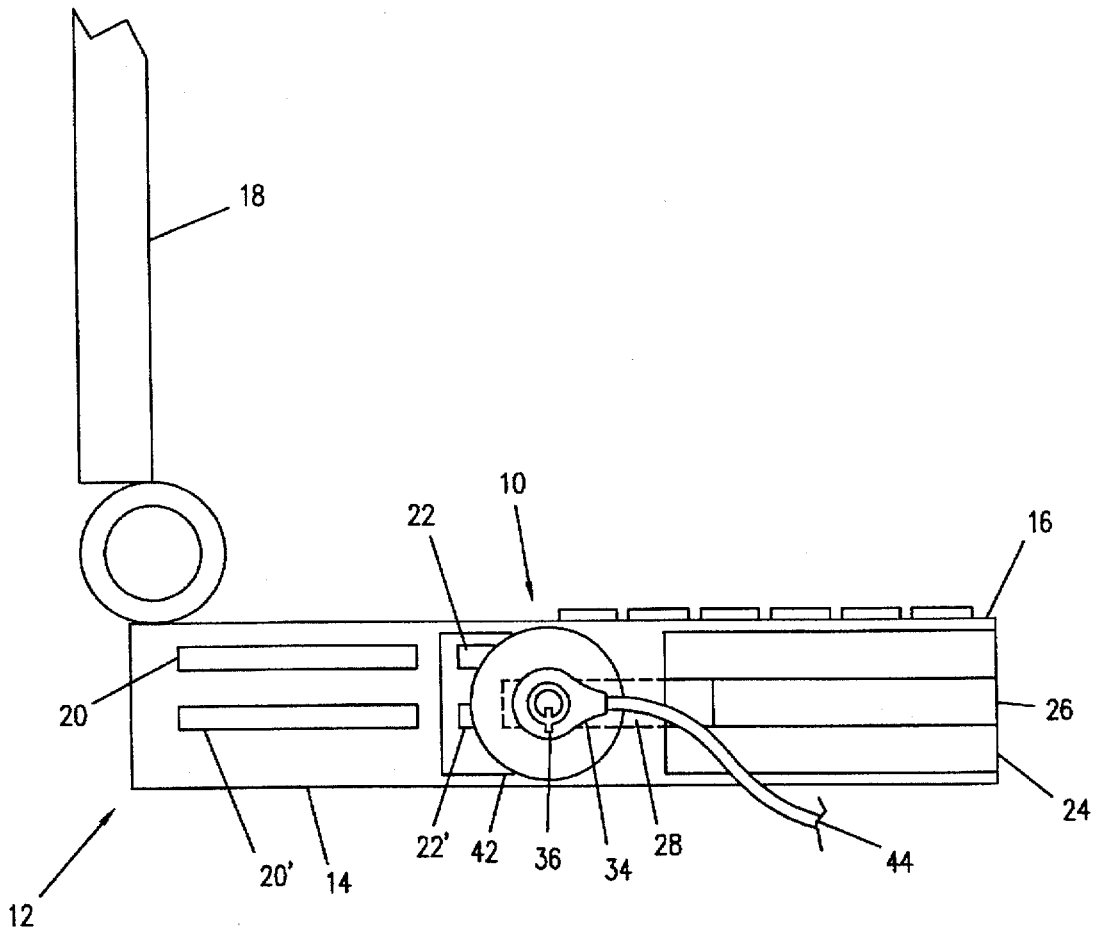
FIG. 3 is a side elevation of a first embodiment of the mechanical lock of the present invention installed on a portable computer.

As shown in FIG. 3, when the mechanical lock 10 is installed on a portable computer 12, the cylindrical flange 42 covers the memory card eject buttons 22, 22' and prevents the buttons from being actuated to release any modular components disposed within the memory card slots 20, 20'.

Thus, when the mechanical lock 10 depicted in FIGS. 1–3 is installed on a portable computer 12, it prevents the unauthorized removal from the portable computer 12 of removable memory cards and a removable hard disk drive.

As mentioned above, a cable 44 optionally may be attached to the mechanical lock 10. It will be understood that the cable 44 may be utilized to attach the portable computer 12 to a secure object.

Figure 4:
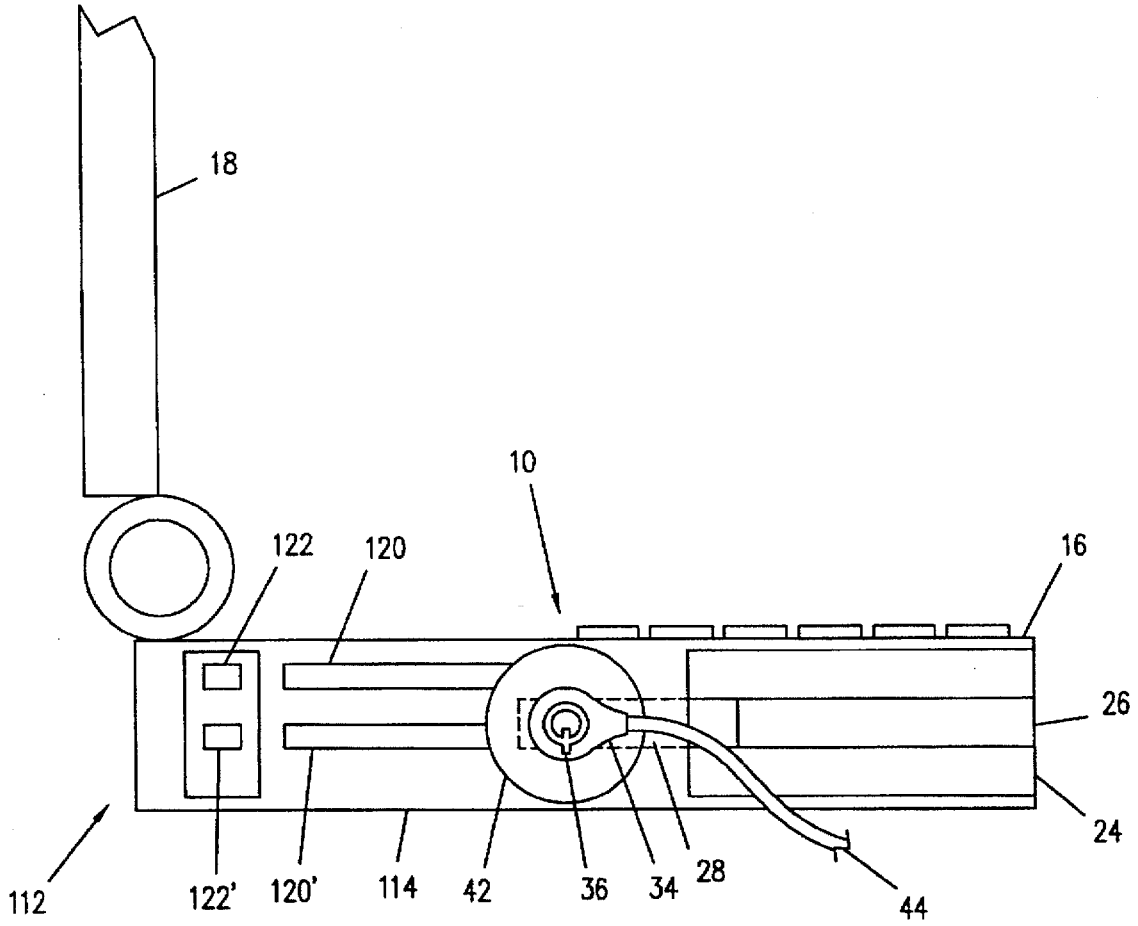
FIG. 4 is a side elevation of a second embodiment of the mechanical lock of the present invention installed on a portable computer.
Figure 5:
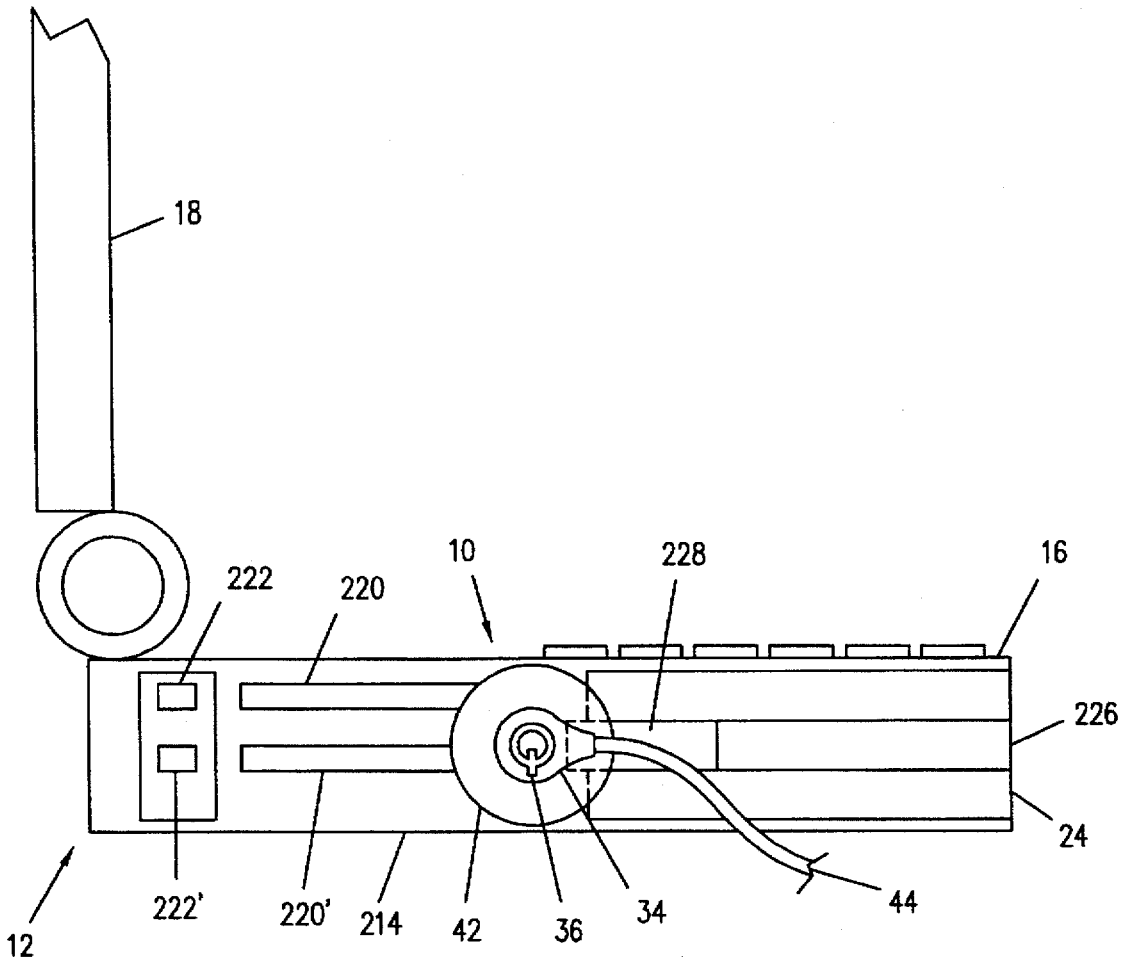
FIG. 5 is a side elevation of a third embodiment of the mechanical lock of the present invention installed on a portable computer.
Figure 6:
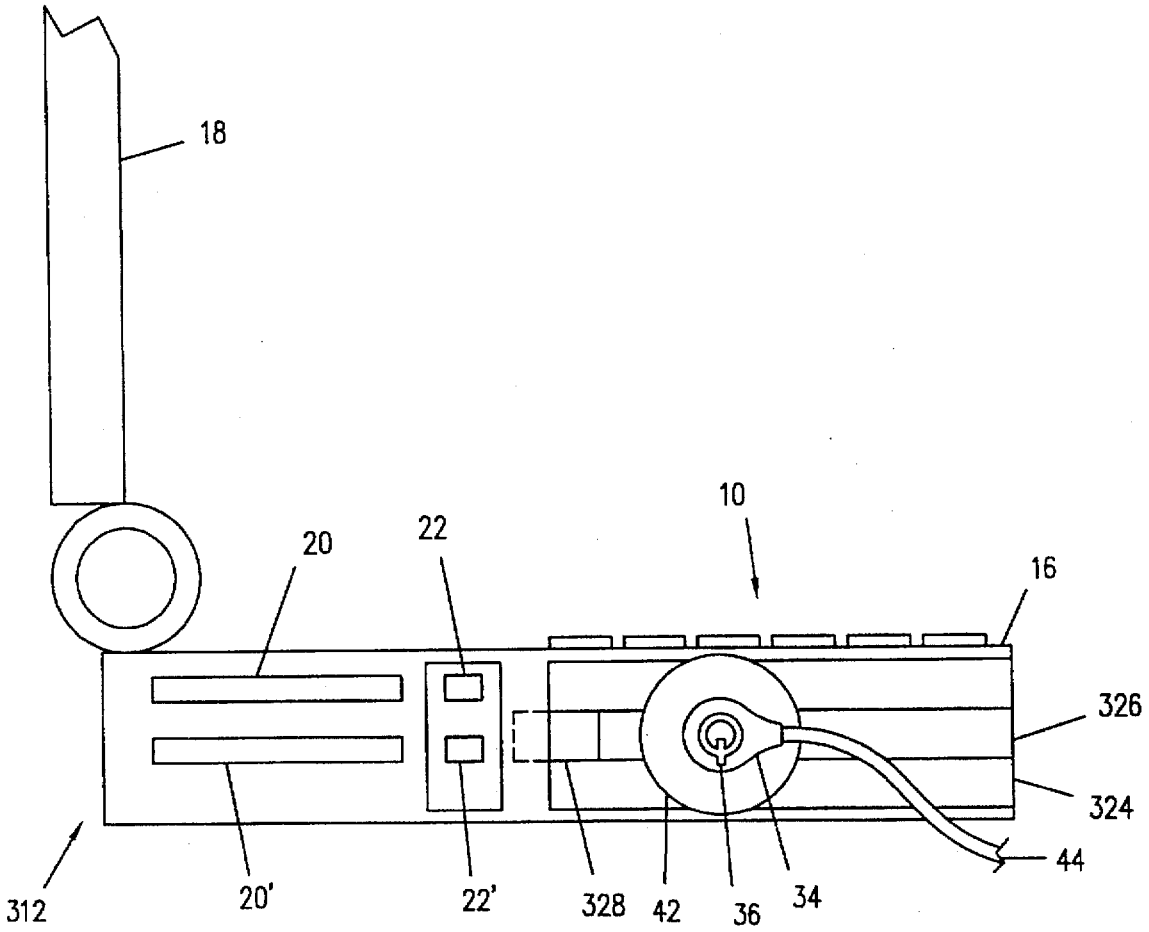
FIG. 6 is a side elevation of a fourth embodiment of the mechanical lock of the present invention installed on a portable computer.

Alternate embodiments of the invention are shown in FIGS. 4–6 in which like parts are designated by the same reference numerals as in FIGS. 1–3.

As shown in FIG. 4, the mechanical lock 10 of the present invention may be utilized to prevent the unauthorized removal of removable memory cards from within a portable computer 112 by orienting the cylindrical flange 42 to block the memory card slots 120, 120' rather than the memory card eject buttons 122, 122'.

In the embodiment shown in FIG. 4 and in a manner similar to the embodiment shown in FIGS. 1–3, when the mechanical lock 10 is installed on a portable computer 112, the end 38 of locking member 36 engages the aperture 32 in tongue 28 to prevent the tongue 28 from being disengaged from the chassis 114 consequently preventing access to the hard disk drive compartment by preventing the door 24 from being opened. Thus, a removable hard disk drive disposed within the hard disk drive compartment is locked within the portable computer 112.

As shown in FIG. 5, the mechanical lock 10 of the present invention may be utilized to prevent the unauthorized removal of removable memory cards from within a portable computer 212 by orienting the cylindrical flange 42 to block the memory card slots 220, 220'. The mechanical lock 10 may also be utilized to prevent the unauthorized removal of a removable hard disk drive by orienting the cylindrical flange 42 in the path of the door 24 to the disk drive compartment to block and prevent the opening of the door 24. In this configuration, the tongue 228 of sliding bar 226 does not include an aperture for engagement with the end 38 of the locking member 36. Instead, when the mechanical lock 10 is installed on a portable computer 212, the end 38 of locking member 36 engages an aperture (not shown) in chassis 214 and is captured behind the chassis 214 when in a locked position.

As shown in FIG. 6, the mechanical lock 10 of the present invention may be installed on a portable computer 312 to prevent the unauthorized removal of a removable hard disk drive by blocking and preventing the opening of the hinged door 324 to the disk drive compartment. In this configuration, the door 324 and the sliding bar 326 includes corresponding openings 30' for engagement with the end 38 of the locking member. In the embodiment shown in FIG. 6 and in a manner similar to the embodiment shown in FIGS. 1–3, when the mechanical lock 10 is installed on the portable computer 312, the end 38 of locking member 36 engages the opening in sliding bar 326 to prevent the tongue 328 from being disengaged from the chassis 314 consequently preventing access to the hard disk drive compartment by preventing the door 324 from being opened. It is understood that the mechanical lock 10 of this embodiment may or may not include the flange 42.

It is understood that the present invention can take many forms and embodiments. The embodiments shown herein are intended to illustrate rather than to limit the invention, it being appreciated that variations may be made without departing from the spirit or the scope of the invention. For example, it is anticipated that the invention may be used to lock any number of modular components to the chassis of a portable computer. In addition to removable hard disk drives and removable memory cards, other removable components may be locked within a portable computer. Also, various types of locking devices may employ principles of the invention.

Although illustrative embodiments of the invention have been shown and described, a wide range of modification, change and substitution is intended in the foregoing disclosure and in some instances some features of the present invention may be employed without a corresponding use of the other features. Accordingly, it is appropriate that the appended claims be construed broadly and in a manner consistent with the scope of the invention.

What is claimed is:

1. A portable computer and lock combination, comprising:

a portable computer comprising a chassis having a hard disk drive compartment and a door for opening and closing said hard disk drive compartment and at least one card receiving slot; and a lock comprising a lock body and locking means disposed at one end of said lock body and a flange disposed about said lock body;

said lock being lockingly engageable by said locking means with an opening in said chassis such that when said lock is so engaged said flange prevents cards from being removed from said at least one card receiving slot; and said flange further prevents said door from being opened such that said door is maintained in a closed position.

said lock thereby simultaneously securing both said at least one card receiving slot and said disk drive compartment of said computer from unauthorized access thereto.

2. A portable computer and lock combination, comprising:

a portable computer comprising a chassis having at least one card receiving slot, a drive compartment and door for opening and dosing said drive compartment, said door including a sliding member engageable with said chassis between an open and closed position; and a lock comprising a lock body, locking means disposed at one end of said lock body and a flange disposed about said lock body;

said lock being locking engageable by said locking means within an opening in said chassis and a corresponding opening in said sliding member, such that when said lock is so engaged said lock body prevents translation of said sliding member, thereby maintaining said door in said dosed position;

and further wherein when said lock is lockingly engaged with said chassis said flange prevents removable components from being removed from said at least one card receiving slot.

said lock thereby simultaneously securing both said at least one card receiving slot and said drive compartment of said computer from unauthorized access thereto.

3. The combination of claim 2 wherein said flange at least partially obstructs said at least one card receiving slot.

4. The combination of claim 2 wherein said chassis further comprises means for ejecting a card from said at least one card receiving slot and wherein said flange at least partially obstructs and prevents the actuation of said ejecting means.

5. The combination of claim 2 wherein said locking means is reciprocatable between a first unlocked position and a second locked position, said chassis opening for receiving said lock body and said sliding member opening registering with said chassis opening allowing passage of said locking means in said first unlocked position and preventing passage of said locking means in said second locked position.

6. Apparatus for securing removable modular components of a computer, the computer including a chassis for removably housing the components, the apparatus comprising:

a door defined in said chassis having a sliding bar which includes a tongue disposed in said chassis, said door for covering at least one said modular component and said tongue being slidably engageable within said chassis between an open and closed position of said door;

an aperture defined in said door;

a lock receivable in said aperture for locking engagement with said chassis;

an aperture defined in said bar for receiving said lock, said door aperture being in alignment with said bar aperture when said door is in said closed position;

such that in said locking engagement, said lock is received in both said door and bar apertures, thus preventing said tongue from sliding to said open position, thereby securing said component.

7. A lock for preventing the removal of cards and modular components from a portable computer, said computer having a drive compartment for housing said modular components and a door for opening and closing said drive compartment, and having a card receiving slot for receiving said cards, said computer further having a chassis containing an opening therein in proximity to both said door and said card receiving slot, the lock comprising:

a lock body adapted to be received in said chassis opening;

reciprocating locking means disposed at one end of said lock body adapted to be lockingly engaged with the chassis of said portable computer; and a flange disposed about said lock body adapted to simultaneously prevent the removal of said cards from said card receiving slot and said modular components from said drive compartment.

8. The lock of claim 7, wherein said flange extends beyond the outer perimeter of said lock body.

9. The lock of claim 7, wherein said lock body is cylindrical and said flange extends beyond the outer perimeter of said lock body.

10. The lock of claim 7, wherein said lock body and said flange are cylindrical and said flange extends beyond the outer perimeter of said lock body.

11. The lock of claim 7, further comprising a cable attached to said lock body.

* * * * *

UNITED STATES PATENT AND TRADEMARK OFFICE

CERTIFICATE OF CORRECTION

PATENT NO. : 5,687,592

DATED : November 18, 1997

INVENTOR(S) : Mark Penniman and John Busch

It is certified that error appears in the above-identified patent and that said Letters Patent is hereby corrected as shown below:

Column 5, line 52, "dosing" should be –closing–.

Column 5, line 63, "dosed" should be –closed–.

Signed and Sealed this

Twentieth Day of July, 1999

*Attest:*

Q. TODD DICKINSON

*Attesting Officer*

*Acting Commissioner of Patents and Trademarks*